US005720257A

United States Patent [19]

Motose et al.

[11] Patent Number: 5,720,257

[45] Date of Patent: Feb. 24, 1998

[54] MULTIPLE CYLINDER ENGINE MANAGEMENT SYSTEM

[75] Inventors: Hitoshi Motose; Hidetoshi Ishigami; Takayuki Anamoto, all of Shizuoka-ken, Japan

[73] Assignee: Yamaha Hatsudoki Kabushiki Kaisha, Shizuoka-ken, Japan

[21] Appl. No.: 544,827

[22] Filed: Oct. 18, 1995

[30] Foreign Application Priority Data

Oct. 18, 1994 [JP] Japan ..... 6-251974

[51] Int. Cl.[6] ..... F02D 17/02; F02D 43/00

[52] U.S. Cl. ..... 123/339.14; 123/73 A; 123/481

[58] Field of Search ..... 123/73 A, 198 F, 123/481, 339.1, 339.14

[56] References Cited

U.S. PATENT DOCUMENTS 4,550,704 11/1985 Barho et al. ..... 123/481
4,768,474 9/1988 Fujimoto ..... 123/73 B
4,991,558 2/1991 Daly et al. ..... 123/481
5,038,739 8/1991 Ishii ..... 123/481
5,140,964 8/1992 Torigai ..... 123/73 A
5,374,224 12/1994 Huffmaster et al. ..... 123/198 F
5,579,736 12/1996 Nakamura et al. ..... 123/339.11

*Primary Examiner*—Tony M. Argenbright
*Attorney, Agent, or Firm*—Knobbe, Martens, Olson & Bear, LLP

[57] ABSTRACT

A fuel induction system for an internal combustion engine which includes a throttle valve that is positioned substantially open under idle and near idle engine running conditions. The system includes means for disabling one or many of the cylinders in order to maintain a low engine rotational speed at idle and near idle and also means for selectively disabling the cylinders in such a manner as to provide the smoothest running engine possible in those instances where one or many of the engine's cylinders are disabled.

54 Claims, 10 Drawing Sheets

4 Active Cylinders

3 Active Cylinders

2 Active Cylinders

MULTIPLE CYLINDER ENGINE MANAGEMENT SYSTEM

BACKGROUND OF THE INVENTION

This invention relates to a multi-cylinder engine and more particularly to an improved management system and control method for such engines.

In many forms of internal combustion engines, there are times when the engine is operated with less than its total number of cylinders running. That is, during the operation of the engine, one or more cylinders may be intentionally disabled and prevented from undergoing combustion. This is done for a variety of purposes.

For example, it has been the practice at times to limit the maximum power output of an engine and to improve its efficiency under some running conditions by disabling certain cylinders. The disabled cylinder or cylinders are prevented from undergoing combustion either by intentionally not firing or misfiring the spark plugs and/or by selectively disabling the supply of fuel to those cylinders. This permits the engine to operate as a variable displacement engine. Thus, only the displacement necessary for any given running condition is employed. This permits increases in the overall efficiency.

This same technique is utilized with engines to permit them to continue to propel the vehicle, but under a reduced speed in the event of some malfunction in the engine. These so called "limp home" modes of operation protect the engine from serious damage, but nevertheless permit the occupants to reach a location where assistance can be obtained.

Another use for such cylinder disabling is disclosed in the copending application of Kazuhiro Nakamura and Kimihiro Nonaka entitled "Combustion Control System for Internal Combustion Engine," Ser. No. 08/299,517, filed Sep. 1, 1994, now U.S. Pat. No. 5,579,736 and assigned to the assignee hereof. In that application, the engine is operated so that the throttle valve is positioned in a substantial partially opened condition under idle and off idle conditions. This improves the performance of the engine on acceleration.

That is, the throttle valve is held more fully opened than with conventional engines so that the engine could induct more air than is necessary for its operation at the idle or off idle speed. The actual engine speed is controlled to the desired speed by selectively disabling one or more cylinders of the engine. The actual number of cylinders disabled will be determined by the actual desired speed for the engine. This system significantly improves engine performance.

As is well known, internal combustion engines and particularly multiple cylinder engines are normally designed so that the cylinders fire at substantially equal intervals from each other. This equal interval firing is employed so as to permit smoother running and facilitate balancing and vibration control of the engine. However, when one or more cylinders are selectively disabled, then the even firing impulse is interrupted and roughness in engine operation may occur.

It is, therefore, a principal object of this invention to provide an improved engine control system wherein one or more cylinders of the engine are selectively disabled for engine control for any of a variety of purposes and wherein the cylinders that are disabled are chosen so as to maintain substantially even firing impulses between the remaining running cylinders.

When the engine is operated by disabling one or more cylinders for some time interval, it is also the practice to vary which cylinders are disabled. For example, if the engine is a six-cylinder engine, first cylinder number one may be disabled for a short time period and then cylinder number two and then cylinder number three, etc. are disabled. Thus, even if the initial disabling of the cylinders is done in such a way that the firing impulses are maintained substantially even, when the cylinder or cylinders disabled are shifted, then the even or more nearly even firing impulses will again be disrupted and rough operation can follow.

This may be understood by reference to FIG. 1 which is a firing diagram for a conventional six-cylinder engine operated on such conventional disabling modes. In this illustrated construction, the engine is of the two-cycle crankcase compression type and, hence, each cylinder fires normally, in a balanced engine, at a 60° interval from the next cylinder to be fired. If the engine is to have its speed or power output reduced by selectively disabling one or more cylinders, the engine is initially operated so that the fifth and sixth cylinders are disabled and cylinders one, two, three and four fire in that order. Hence, there is a 60° interval between the firing of cylinders one and two, two and three, and three and four. However, there is a 180° interval between the firing of cylinder number four and cylinder number one.

If the engine is operated for any significant time period on less than all cylinders, then eventually cylinder six continues to be disabled, but cylinder five begins firing and cylinder one is then disabled in place of cylinder five. Hence, cylinders two, three, four and five then fire in that order. Again, there is a 60° interval between the firing between cylinders two and three, three and four, and four and five. Again, however, there is a 180° interval between the firing of cylinder five and the next time cylinder two fires. This disabling will continue through this sequence with one cylinder being dropped and another being added, depending upon how long the condition persists during which not all cylinders are fired. Thus, although with this arrangement any one cylinder is not disabled for the total time period, there is, nevertheless, uneven firing and rough engine operation can result.

It is, therefore, a still further object of this invention to provide an improved control arrangement for a multi-cylinder engine wherein different cylinders are disabled during prolonged running under a controlled condition, but wherein, even though different cylinders are disabled, substantially equal firing intervals are maintained so as to promote smooth engine running.

It should be noted that, although reference is made to "cylinders" the same principles may be applied to rotary engines. Hence the terms "cylinders" or "combustion chambers" as used herein are intended to encompass either reciprocating or rotary engines, unless otherwise so specified.

SUMMARY OF THE INVENTION

First features of this invention are adapted to be embodied in an internal combustion engine and method of operating such an engine. The engine has a plurality of combustion chambers and an induction system is provided for supplying an air charge to the combustion chambers. A charge forming system is provided for supplying fuel to the combustion chambers for combustion therein. An ignition system is also provided for igniting the charge in the combustion chambers for effecting the combustion in the combustion chambers. Means are provided for sensing an engine condition when the engine need not develop the total power required by the operation of all of the cylinders.

In accordance with a method for performing this first feature of the invention with an engine as described in the preceding paragraph, means are provided for operating one of the systems so as to selectively disable the combustion from occurring in one or more of the combustion chambers while still maintaining a substantially uniform firing pattern in the combustion chambers. If the condition prevails for a time period, other cylinders are selectively disabled while maintaining the same total number of cylinders which undergo combustion and while still maintaining substantially equal intervals between the combustion in those combustion chambers.

In accordance with engine for operating under this principle, the engine includes a sensor for sensing a condition when not all combustion chambers need operate to supply the desired power output from the engine. When that condition is sensed, at least one of the systems is controlled for selectively disabling a given number of combustion chambers while maintaining a substantially equal firing interval between the remaining combustion chambers. The combustion chambers which are disabled are changed when the condition prevails for a predetermined time period and the substantially equal firing interval between the running combustion chambers is maintained.

Another feature of the invention is also adapted to be embodied in an internal combustion engine and a method of operating the engine. In accordance with these other features, the engine also has a plurality of combustion chambers and an induction system for supplying an air charge to the combustion chambers which includes a throttle valve for controlling the flow through the induction system. A charge forming system is provided for supplying fuel to the combustion chambers for combustion therein. An ignition system is provided for igniting the charge in the combustion chambers for effecting the combustion. Means are provided for controlling the position of the throttle valve under at least one running condition for permitting a greater air flow through the induction system than is required to operate the engine at the desired speed for that running condition.

In accordance with a method for performing this feature of the invention, the speed of the engine at the one running condition is controlled by controlling at least one of the systems associated with at least some of the combustion chambers for precluding combustion therein while maintaining substantially equal firing intervals between the combustion chambers.

In accordance with an engine that practices the invention, the engine control includes a control which controls the actual speed of the engine at the one running condition by affecting at least one of the systems so that some of the combustion chambers will not experience combustion therein while still maintaining substantially equal firing intervals between those combustion chambers where combustion does occur.

DETAILED DESCRIPTION OF THE PREFERRED EMBODIMENTS OF THE INVENTION

Figure 2:
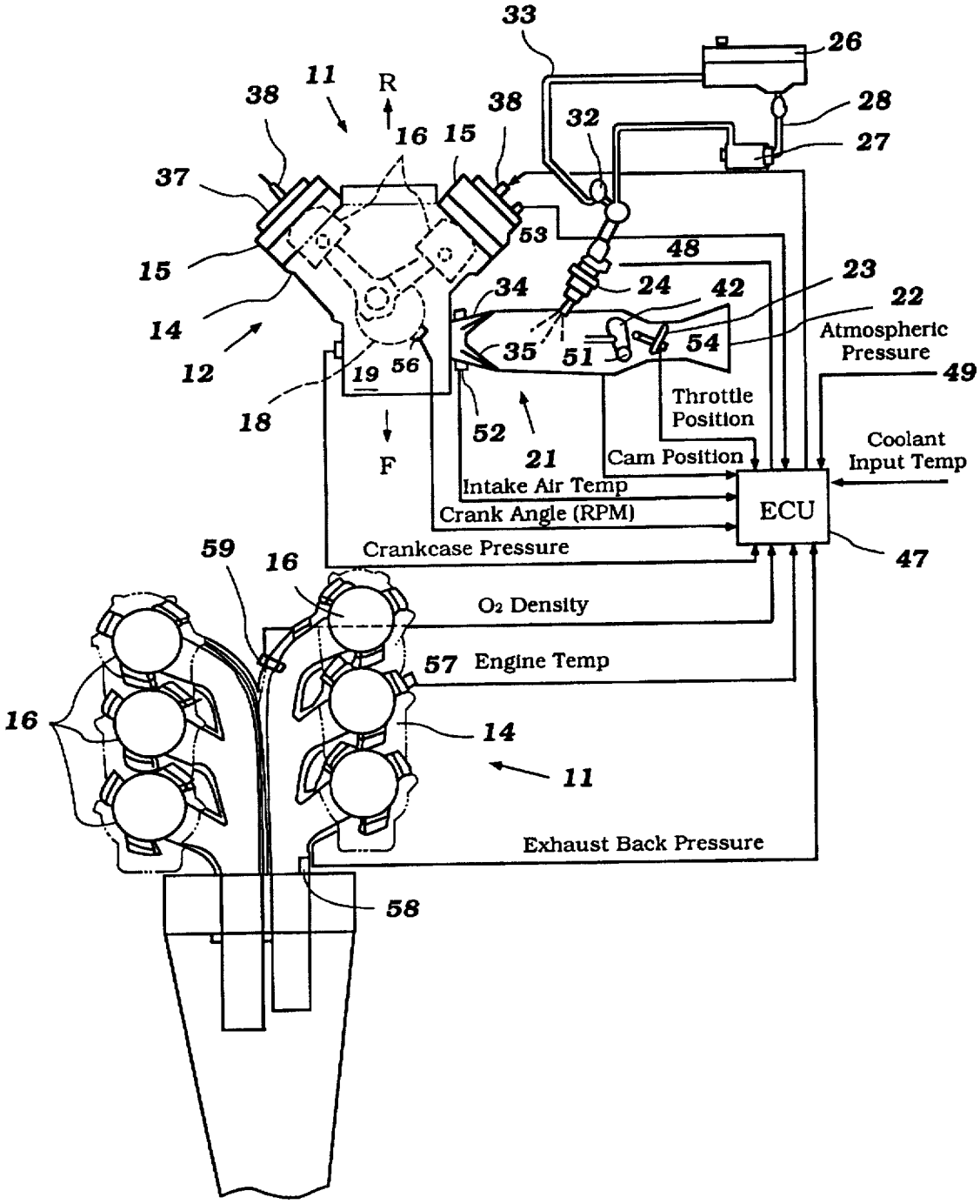
FIG. 2 is a partially schematic composite view showing a rear elevational view of a portion of an outboard motor, with parts of the engine broken away and shown in phantom and also a schematic top plan view of the engine and showing the systems associated with it and which control the engine.

Referring now in detail to the drawings and initially to FIG. 2, an outboard motor is shown partially in cross section and with portions shown in phantom and is identified generally by the reference numeral 11. This view is a partially schematic composite view showing a rear elevational view of a portion of an outboard motor and with the powering internal combustion engine shown in top plan view. The engine is identified with the reference numeral 12 and the associated induction system and fuel injection system are shown partially in cross section and partially schematically. The invention is described in conjunction with an outboard motor only as a typical environment in which the invention may be practiced. The invention has particular utility with two cycle crankcase compression internal combustion engines and since such engines are frequently employed as the power plants for outboard motors, an outboard motor is a typical environment in which the invention may be employed. However, the present invention is also applicable to other engines such as four cycle engines and with other engine applications.

The outboard motor 11, as already noted, includes a powering internal combustion engine 12 which, in the illustrated embodiment, is comprised of a six cylinder V-type (V-6) engine. It will be readily apparent to those skilled in the art how the invention can be employed in connection with engines of other configurations.

The engine 12 forms a portion of the power head of the outboard motor and this power head is completed by a protective cowling (not shown) which surrounds the engine 12 in a known manner. As may be seen in this figure, the engine 12 is comprised of two cylinder banks 14 each of which includes three aligned cylinder bores 15. Pistons 16 reciprocate in the cylinder bores 15 and are connected to connecting rods 17 which, in turn, drive a crankshaft 18 in a well known manner. The crankshaft 18 is rotatably journaled within a crankcase assembly which is divided into individual chambers 19 each associated with a respective one of the cylinder bores 15 and which are sealed from each other in a manner well known in the art.

A fuel/air charge is delivered to the crankcase chambers 19 by an induction system, indicated generally by the reference numeral 21, and which includes an atmospheric air inlet 22. The induction system 21 includes a throttle valve 23 having a control lever 25 which is attached to the throttle valve 23 as shown in the enlarged view of FIG. 3 through the throttle valve shaft. As is well known in the art, the position of the throttle valve 23 determines the amount of air introduced to the crankcase chambers 19. The position of the throttle valve 23 is controlled in a manner which will be described.

As shown in FIG. 2, an electronically operated fuel injector 24 sprays fuel into the induction system 21 downstream of the throttle valve 23. The fuel injector 24 receives fuel from a fuel system including a remotely positioned fuel tank 26. Fuel is drawn from the fuel tank 26 by means of a high pressure fuel pump 27, through a conduit 28 in which a filter 29 is positioned. This fuel is then delivered to a fuel rail 31 in which a pressure regulator 32 is provided. The pressure regulator 32 maintains the desired pressure in the fuel rail by bypassing excess fuel back to the fuel tank 26 through a return conduit 33.

The induction system 21 delivers air to the intake ports of the engine through reed type check valves 35 which operate to preclude reverse flow. The inducted charge is drawn into the crankcase chambers 19 upon upward movement of the pistons 16 and then is compressed upon downward movement. At this time the check valve 35 closes to permit the charge to be compressed in the crankcase chamber 19. The compressed charge is transferred to the area above the pistons 16 through a plurality of scavenge passages (not shown) in a manner well known in this art.

A cylinder head 37 is affixed to the cylinder block 14 in a known manner and defines a recess which forms part of the combustion chamber. A spark plug 38 is mounted in each cylinder recess and is fired by the ignition system in a known manner. The ignition system is controlled in a manner as will be described.

Figure 3:
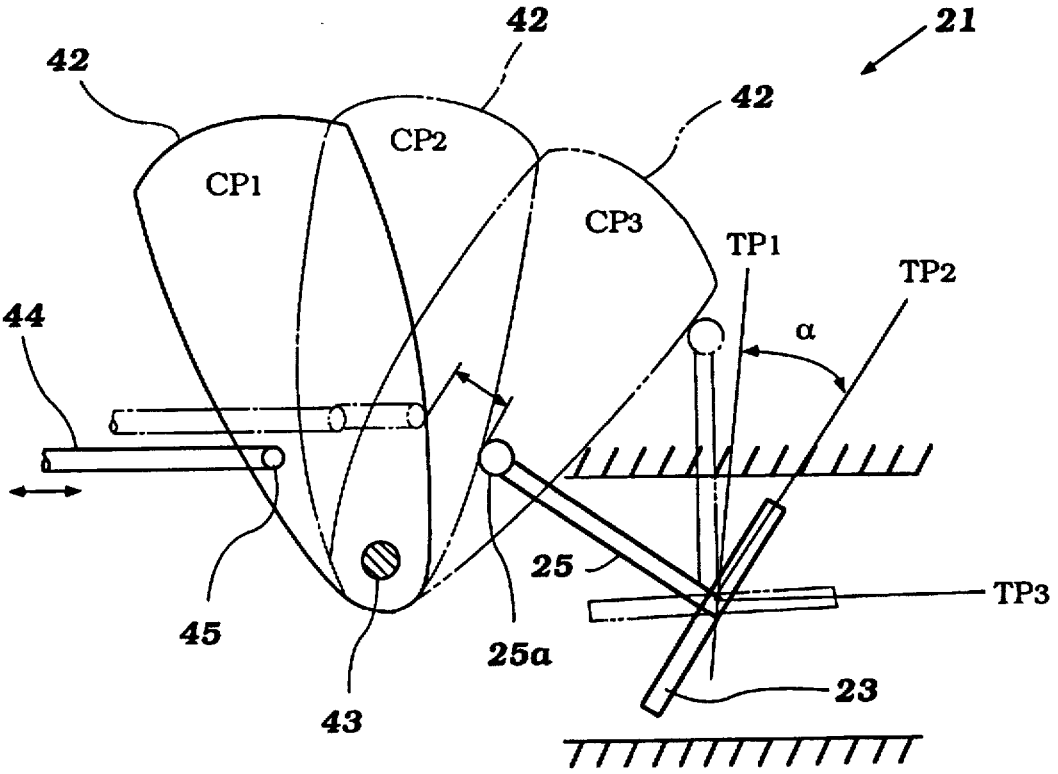
FIG. 3 is an enlarged cross-sectional view showing the throttle valve and throttle valve actuating mechanism in according with a feature of the invention showing the throttle valve and control in various positions from idle (solid line view) through wide open throttle(phantom line views).

As also shown in FIG. 3, the induction system 21 further includes a lost motion connection indicated generally by the reference numeral 41 through which the throttle valve 23 is controlled. This lost motion connection consists of a cam member 42 and an accelerator rod 44. The accelerator rod 44 is connected to the cam member 42 through a pin 45. The other end of the accelerator rod 44 is connected to a remote operator actuated throttle control (not shown) to provide a stroke which corresponds to the desired movement of the throttle valve 23 and the operator desired power output of the engine 12. The cam member 42 is pivotally supported to rotate about pin a 43. The control lever 25 of the throttle valve 23 has a contact portion **25*a* at its end to contact with the circumference of the cam member 42 when the cam member 42 is driven by the accelerator rod 44**. The operation of the lost motion connection cam mechanism will be described in more detail later.

As is typical with outboard motor practice, the cylinder block 14 and cylinder heads 37 are formed with cooling jackets through which coolant is circulated from the body of water in which the outboard motor 11 is operating in any conventional manner.

Referring now in more detail to the induction system, the fuel injection system and the control therefor, the movement of the throttle 23 and the cam member 42 in the induction system 21 is monitored. The ignition timing for the spark plug 38 and the fuel injection for the crank chambers 19 from the fuel injector 24 are electronically controlled. An ECU 47 is provided for this control.

To this end, the induction 21 is provided with a throttle valve position sensor 54 which senses the position, i.e., angular movement, of the throttle valve 23 and outputs the sensed signal to the ECU 47. The induction system 21 is further provided with a cam position sensor 51 which senses the position, i.e., angular movement, of the cam member and accordingly the operator demand. The sensor outputs the resulting signal to the ECU 47. The combustion control system of the present invention further includes various sensors which will be described later.

The fuel injector 24 is provided with an electrical terminal that receives an output control signal from ECU 47 through a conductor indicated by the line 48. A solenoid of the fuel injector 24 is energized when the ECU 47 outputs a signal to the fuel injector 24 through the line 48 to open an injection valve and initiate injection. Once this signal is terminated, injection will also be terminated. The injector 24 may be of any known type and in addition to a pure fuel injector, it may comprise an air/fuel injector.

A number of ambient atmospheric condition signals are supplied to the ECU 47 and certain engine running conditions are supplied to the ECU 47 so as to determine the ignition timing by the ignition system, the amount of fuel injected and the timing of the fuel injection by the fuel injector 24. These ambient conditions may comprise atmospheric pressure which is measured in any suitable manner by a sensor and which signal is transmitted to the ECU 47 through a conductor 49, temperature of the cooling water which is delivered to the engine cooling jacket from the body of water in which the watercraft is operating as sensed by an appropriate sensor (not shown) and transmitted to the ECU 47 through a conductor, and the intake air temperature as sensed in the crankcase chamber 19 by a temperature sensor 52 which outputs its signal to the ECU 47 through a conductor. Additional ambient conditions may be measured and employed so as to provide more accurate control of the fuel injection, if desired.

In addition to the throttle valve position sensor and the cam position sensor as noted above, there are also provided a number of engine condition sensors which sense the following engine conditions. An in-cylinder pressure sensor 53 senses the pressure within the cylinder and outputs this signal to the ECU 47 through an appropriate conductor. Crankcase pressure is sensed by a pressure sensor 55 which is also mounted in the crankcase chamber 19 and outputs its signal to the ECU 47. Crank angle position indicative of the angular position and rotating speed of the crankshaft 18 is determined by a sensor 56 and outputted to the ECU 47. As is well known, by measuring crankcase pressure at certain crank angles the amount of air inducted may be accurately determined.

Engine temperature or intake air temperature is sensed by a sensor 57 mounted in the cylinder block 14 and inputted to the ECU 47. Exhaust system back pressure is sensed by a sensor 58 and is outputted to the ECU 47. Finally, an oxygen sensor 59 outputs a signal indicative the fuel air ratio by sensing the exhaust gas in the exhaust manifold of the engine and outputs its signal to the ECU 47.

As with the ambient conditions, additional engine running conditions may be sensed. Those skilled in the art can readily determine how such other ambient or running conditions can be sensed and fed to the ECU 47 and processed by the ECU 47 to determine the ignition timing and the fuel injection supply both in timing and amount. The ECU 47 is provided with an information table or a map for determining the ignition timing and the fuel supply based on the various parameters in the engine as above which will be described in detail later.

The engine 12 is operated so that the throttle valve 23 is positioned in a substantial partially opened condition under idle and off idle conditions in order to improve the performance of the engine under acceleration as disclosed in the copending application of Kazahiro Nahamura and Kimishiro Nonaka entitled "Combustion Control System For Internal Combustion Engine", Ser. No. 08/299,517, filed Sep. 1, 1994, now U.S. Pat. No. 5,579,736 and assigned to the assignee hereof. By positioning the throttle valve 23 more fully open the engine is able to induct more air at a higher speed into the crankcase chambers 19 when accelerating under idle and off idle conditions than is possible with conventional engines.

The method for positioning the throttle valve 23 will now be described in more detail with reference to FIG. 3. In the idle condition the accelerator controlled cam 42 will be in the solid line position and spaced from the contact portion 25*a* of the throttle rod 25 due to the partially opened position of the throttle valve 23.

Under this condition the engine could induct more air than required for idle operation. The idle speed is maintained by misfiring or skipping firing of some cylinders under this condition. How this is done will be described later. Basically from idle until the operator controlled cam 42 contacts the throttle rod portion 25*a* speed is controlled by the number of operative cylinders and other controls than throttle valve position as will be described later.

Initial operator input from the accelerator control (not shown) is communicated to the throttle valve 23 by the cam mechanism 41 which operates as a "lost motion connection" on the throttle valve 23. That is, any accelerator control input moves the accelerator rod 44 to the right, which induces a clockwise rotation of the cam member 42 about the pivot pin 43 from its idle position at CP1 where it is at a distance S from the throttle valve pick-up bar 25. Continued accelerator control input eventually causes contact between the circumferential face of the cam member 42 and the contact portion 25*a* of the throttle lever 25, which occurs when cam member 42 is at the position designated by CP2.

Further accelerator control input will cause the throttle lever 25 to slide up the face of the cam member 42 thus rotating the throttle valve 23 in a clockwise direction to a more open position and eventually to the fully opened position of CP3. Thus it is readily apparent that any initial accelerator control movement which positions the cam member 42 between locations CP1 and CP2 inclusive is not communicated to the throttle valve 23 which will therefore remain in its substantial partially open position. Any further control movement, however, will be directly communicated to the throttle valve 23 and result in the throttle valve 23 opening further with the effect of inducing engine acceleration.

Thus far described is a combustion control system for an engine that is so arranged that the throttle valve 23 is substantially opened in the engine idle state so as to provide sufficient airflow to the engine in response to the fast change over from idle to an acceleration condition. This arrangement, however, creates an adverse situation where the higher air flow rate and air speed tends to increase the engine's idle rotation speed.

The tendency of the higher airflow supplied to the engine 12 caused by throttle valve 23 being substantially opened at idle to increase the engine's idle rotation speed can be eliminated by incorporating into the engine's combustion control system the ability to selectively suspend the combustion operation of one or many of the engine's cylinders. By reducing the number of active cylinders it is possible to keep the engine rotation low when idling even though the throttle valve 23 is substantially opened causing high airflow rates and speed.

The selected cylinder or cylinders are disabled by the ECU 47 which discontinues the supply of fuel thereto. The spark plug 38, however, will continue to fire in order to insure that the combustion mixture already present in the discontinued cylinder or cylinders will be ignited rather than exhausted to the atmosphere thus causing unwanted hydrocarbon emissions.

Figure 1:
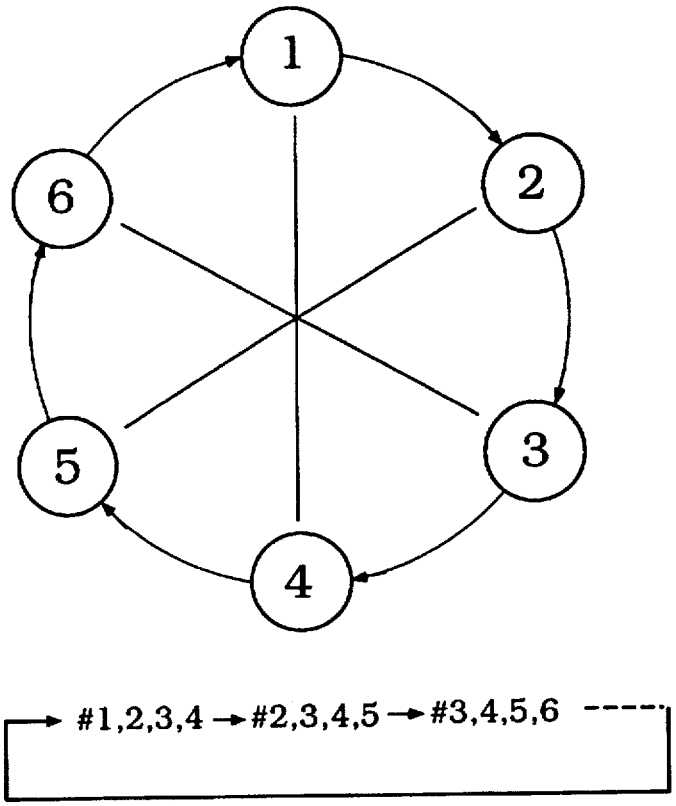
Figure 1 Prior Art
FIG. 1 is a timing diagram for a six-cylinder engine operated in accordance with a prior art method wherein engine output is controlled by selectively disabling certain cylinders.

The cylinder or cylinders which are disabled at a given time could be in accordance with a prior art method of disabling cylinders from combustion as shown in FIG. 1. As has been noted, this is a timing diagram for a six cylinder engine with two of its cylinders disabled. Initially cylinders 1, 2, 3, and 4 are active while cylinders 5 and 6 are disabled. However, if the engine 12 continues to operate with two inactive cylinders for some period of time designated by the ECU 47, the ECU 47 will discontinue operation of cylinder number 1 while simultaneously activating cylinder number 5. The ECU 47 will continue this cyclic procedure until such time as the engine 12 leaves the operating environment in which the ECU 47 disables two cylinders. Should the ECU 47 later once again disable two cylinders the cycle would resume where it was interrupted; that is, if cylinders 2,3,4, and 5 were active prior to the engine 12 resuming normal operation with all six cylinders active then cylinders 3, 4, 5, and 6 would be the initial active cylinders when the engine 12 next begins operation with two cylinders disabled.

Figure 11:
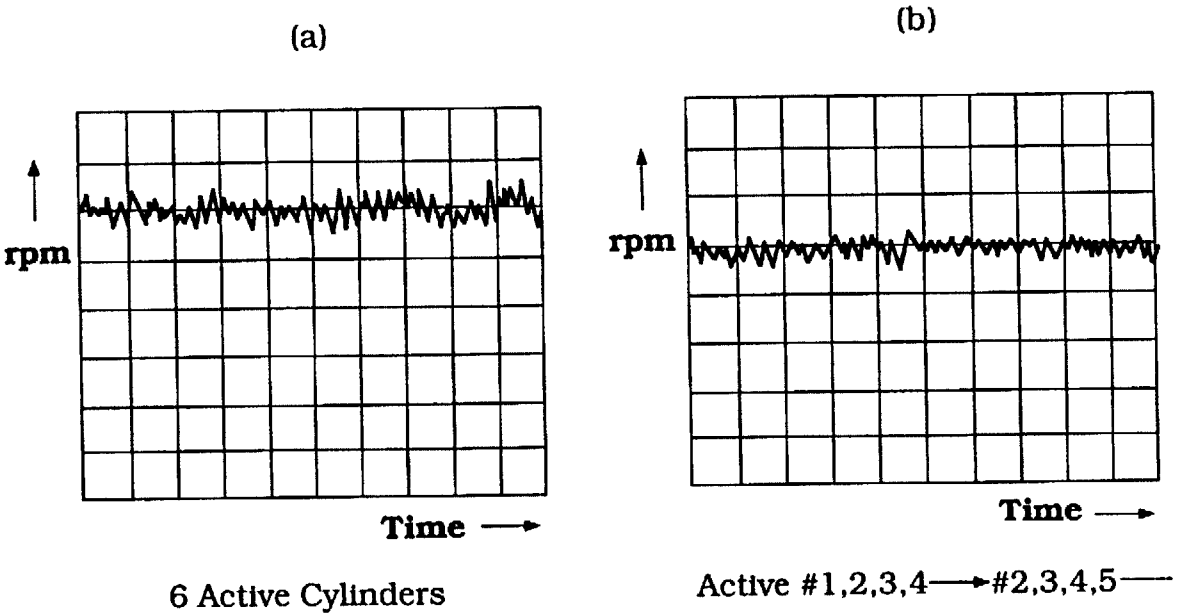
FIG. 11 is a graphical view showing a conventional prior art engine speed variation at a predetermined desired speed with all cylinders operating or with two cylinders selectively disabled, and varying which two cylinders are disabled in accordance with a prior art type of construction.

While this practice is successful in maintaining the engine's desired low rotation speed at idle it does so at the expense of smooth, balanced engine operation. This rough running engine operation is illustrated by again considering the operation of the six cylinder engine operating with two cylinders disabled as shown in FIG. 1. In the situation where cylinders 1, 2, 3, and 4 are active it is readily apparent that a sixty degree firing interval exists between the firing of cylinders 1 and 2, 2 and 3, and 3 and 4. However, there is a one hundred and eighty degree firing interval between the firing of cylinders 4 and 1. This uneven spacing in the firing of the active cylinders causes the engine to run rough and vibrate in an undesirable manner. This condition is shown in the right side view (b) of FIG. 11. Normal 6 cylinder operation appears on the left hand side view (a).

An embodiment of this invention minimizes this unbalanced behavior by selectively disabling cylinders in such a manner as to more evenly distribute the active cylinder firings for a given period of engine rotation. The cylinders are disabled by the ECU 47 when a signal sent to the ECU 47 from the cam position sensor 51 indicates that an engine condition exists where it is necessary to suspend the operation of one or more of the cylinders of the engine 12 in order to maintain a low engine revolution state under idle or near idle conditions.

As already stated, the cam position sensor 51 senses the position, i.e., angular movement, of the cam member 42 and outputs the resulting signal to the ECU 47. Based on this cam member position information the ECU 47 determines how many cylinders to disable in order to maintain the desired engine rotation speed. Thus, with reference to FIGS. 2, 8, 9, and 10, when the cam position sensor 51 indicates an idle position for the cam member 42 at the location CP1 the ECU 47 will disable the maximum allowable number of cylinders, namely four as shown in FIG. 10, leaving two cylinders active a supplying ample energy to the engine crankshaft to maintain the desired engine rotation speed.

Figure 9:
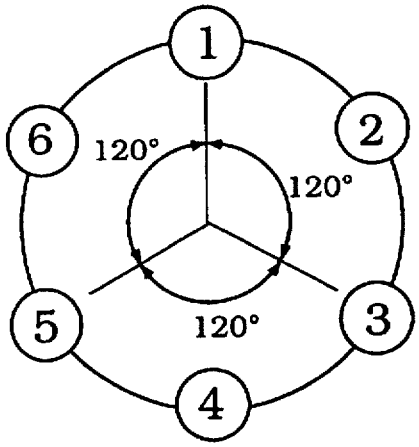
FIG. 9 is a view of the same engine, but showing how the engine is operated when three cylinders are disabled.

As the cam member 42 continues to rotate clockwise towards position CP2, as it would when an acceleration is input to the operator control (not shown), the ECU 47 will activate an additional cylinder as shown in FIG. 9 until such time as four of the six cylinders are active when the cam member 42 is actually at the CP2 position. Any further clockwise rotation of cam member 42 under increased demand will cause the ECU 47 to activate all the cylinders until such time as when, in the normal operation of the engine 12.

When the cam member 42 returns to an idle or near idle position between CP2 and CP2 inclusively, as it would when the operator demand is removed or reduced, at which time the ECU 47 will once again disable a number of cylinders appropriate to the new position of the cam member 42 as indicated by cam position sensor 51. Thus, the ECU control of the activating and disabling of cylinders serves to more smoothly accelerate the engine 12 from an idle rotation speed to a significantly higher operational rotation speed and decelerate the engine 12 back to an idle rotation speed in like smooth manner.

Figure 8:
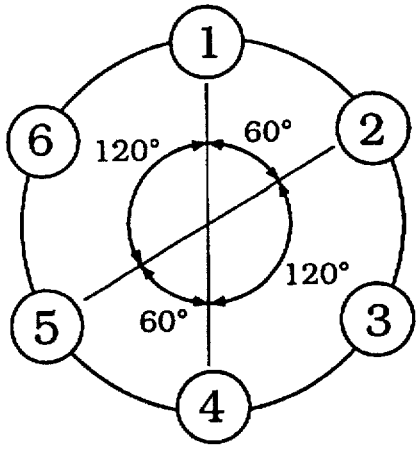
FIG. 8 is a graphical view showing a six-cylinder engine and how two cylinders may be selectively disabled so that the engine operates on four cylinders and has more even firing intervals between the cylinders.
Figure 10:
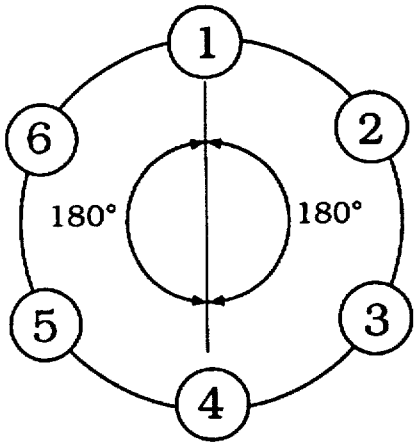
FIG. 10 is a graphical view, in part similar to FIGS. 8 and 9, and shows the operation with four cylinders disabled.
Figure 12:
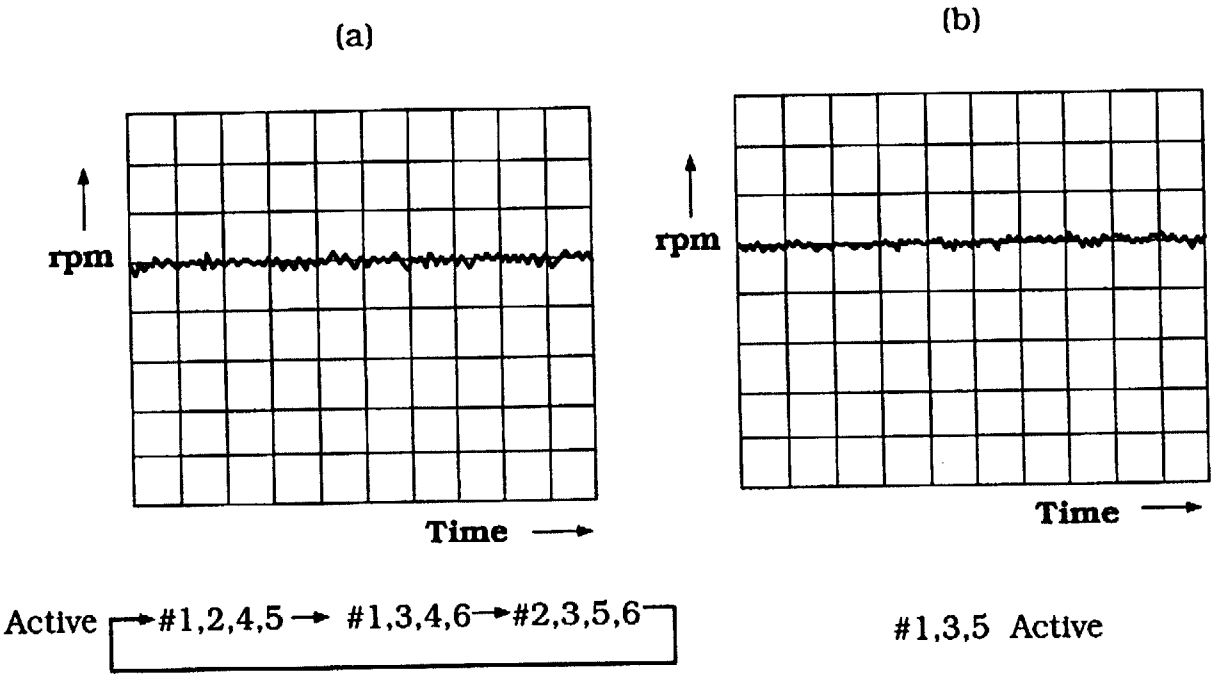
FIG. 12 is a graphical view showing the engine operated in accordance with an embodiment of the invention and running on four or three of the six cylinders.

In addition to illustrating the number of disabled cylinders in the engine 12 in a given idle or near idle circumstance, FIGS. 8 through 10 also show the initial firing sequence of the active cylinders and their angular spacing firing relationship relative to each other. It is readily apparent that the firing intervals utilized are those which most evenly distribute the firing of the active cylinders across an engine rotation cycle and thus result in the smoothest possible engine running condition. Thus, for the situation described by FIG. 8 where two cylinders are disabled and the initial cylinder firing order is 1–2–4–5, the firing interval alternates between sixty an one hundred and twenty degrees and provides a smoother running condition than would the conventional firing order of 1–2–3–4 as can be seen by referring to FIG. 11*b*, which shows the engine rotational speed variation for four active cylinders firing in a 1–2–3–4 order and FIG. 12, which shows the rotational speed variation for an engine operating with the vibrationally superior 1–2–4–5 firing order. If the condition continues, other cylinders are skipped and those previously skipped will be fired. The more even spacing of the firings are, however, retained as seen in FIG. 12(*a*).

Figure 13:
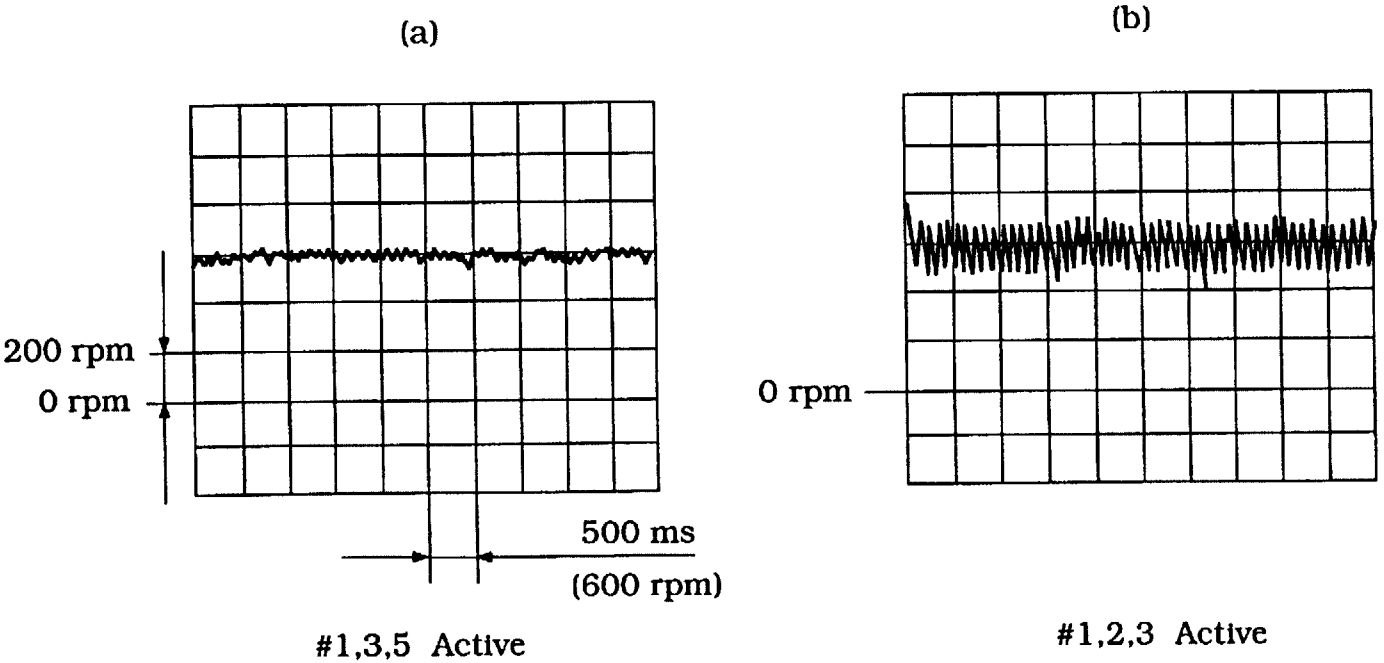
FIG. 13 is a graphical view showing how an idle speed of 600 rpm can be maintained more smoothly when operating the engine on only three cylinders in accordance with this invention as compared to the prior art type of method.

In the situation shown in FIG. 9 where three cylinders are disabled, the initial firing order is 1–3–5. Thus, the firing interval between cylinders is a constant one hundred and twenty degrees; a very smooth operating condition as shown in FIG. 13 where the 1–3–5 firing order engine rotational speed variation is compared with that of an engine with an initial 1–2–3 firing order whose firing interval varies between sixty and two hundred and forty degrees. Again if the running condition continues, other cylinders are fired and disabled while maintaining the even firing intervals.

Figure 14:
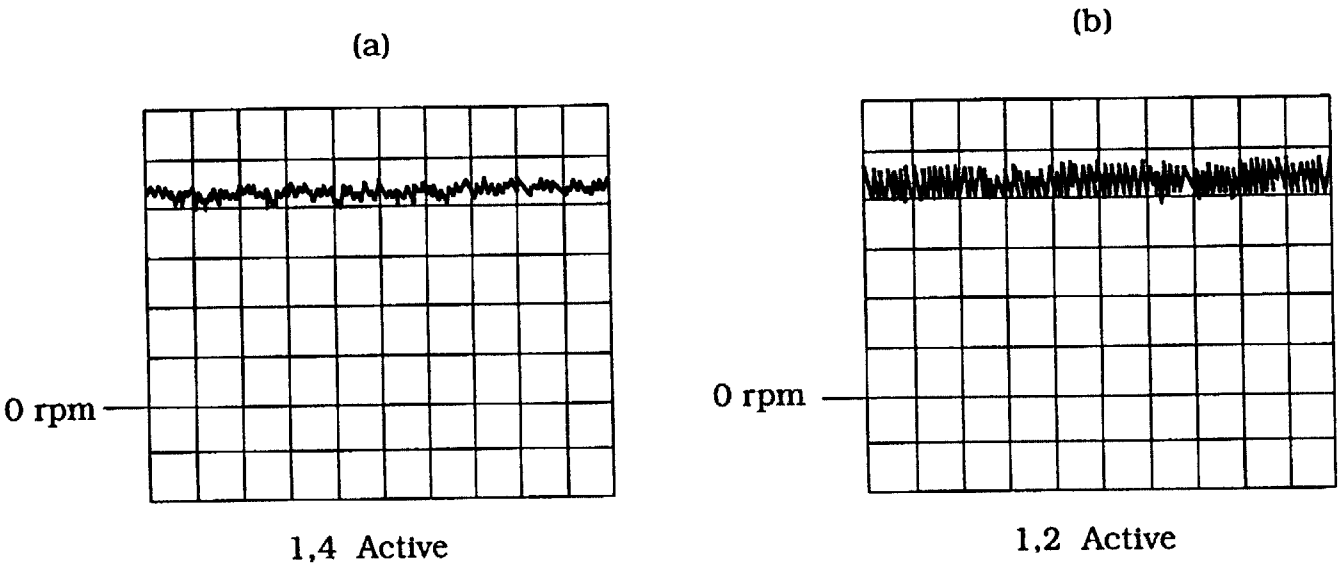
FIG. 14 is a graphical view showing how the engine operating on the principle of the invention operates more smoothly when running on four cylinders as compared to the prior art type of construction at an off idle speed.

And finally, for the situation described by FIG. 10 where four cylinders are disabled and the initial firing order is 1–4 the firing interval between cylinders is a constant one hundred and eighty degrees; again a relatively smooth operating condition as shown in FIG. 14 where the 1–4 firing order engine rotational speed variation is compared with that of an engine with an initial 1–2 firing order whose firing interval varies between sixty and three hundred degrees. As before, if this running condition remains, different cylinders will be fired and disabled while the even firing is maintained.

Figure 5:
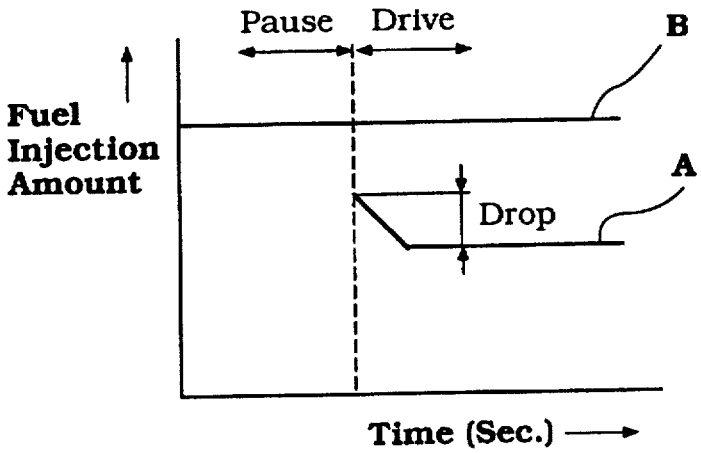
FIG. 5 is a graphical view showing the fuel supply to an uncontrolled cylinder and a controlled cylinder during a time range of the control phase.

At such times as when the firing of cylinders is resumed by restoring the fuel supply to them it has been found that smoother return and better emission control can be achieved if the amount of fuel is not immediately restored, but is rather ramped up as shown in FIG. 5. Also the spark firing may be delayed for a short time interval. This is because there will be a delay between the time when injection is initiated and the fuel actually reaches the combustion chamber. Premature firing of the spark plug 38 could cause backfiring under such circumstances. Thus the resumption of spark plug firing is delayed for a brief number of engine revolutions.

While the above described method of selectively activating and disabling engine cylinders as deemed necessary by ECU 47 for a given operating condition does so in a relatively smooth manner it can be further improved by altering the spark timing as the number of firing cylinders is changed. This provides as gradual transition period and/or better speed control as shown in FIGS. 6 and 7.

Figure 6:
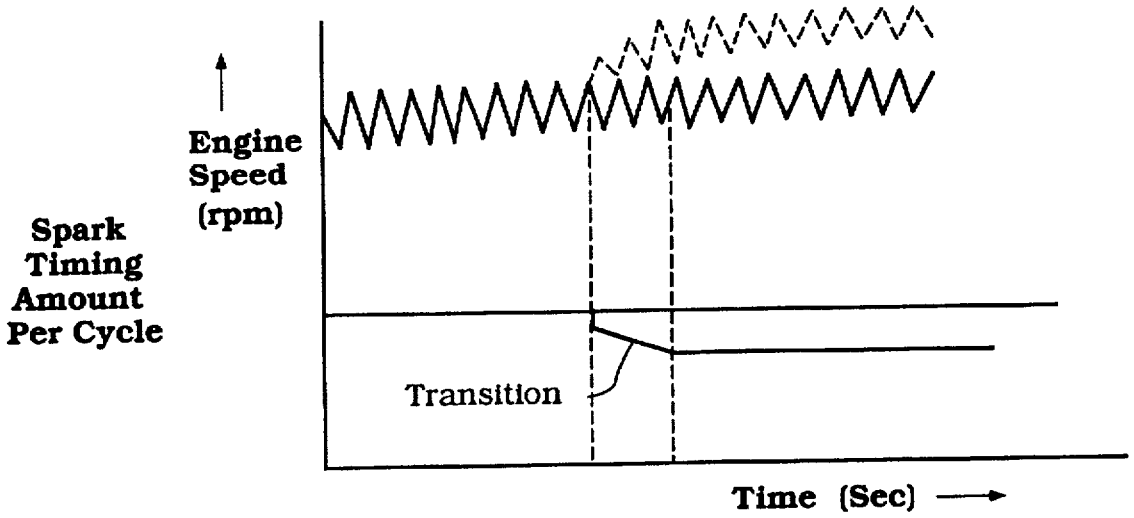
FIG. 6 is a graphical view showing engine speed and spark timing and shows how the engine speed is maintained and how over speed is avoided.

FIG. 6 shows the engine operating condition for the engine 12 when a cylinder has just been activated by ECU 47. Visible on the figure are both solid and dashed saw-tooth curves indicating engine rotational speed, and a relatively horizontal solid curve indicating the change in spark timing. It is apparent that when the cylinder activates, the amount of spark timing is retarded as a step function at the beginning of the transition period and then more gradually ramps down to a new constant value by the end of the transition period. The solid saw-tooth curve shows that the engine rotation speed which is seen to remain undisturbed throughout the transition period and beyond. The dashed saw-tooth curve shows what would have happened to the engine rotational speed had the spark timing not been altered. It is seen that in such a case the engine 12 would have sped up more than desired.

Figure 7:
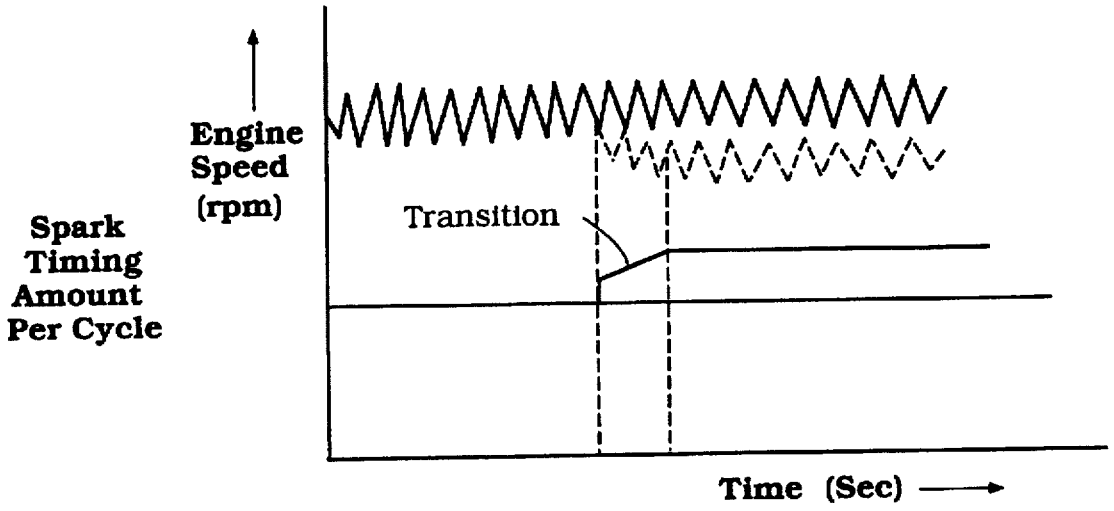
FIG. 7 is a graphical view, in part similar to FIG. 6, and shows how a fall off or reduction in speed is avoided.

FIG. 7 shows the engine operating conditions for the engine 12 when a cylinder has just been disabled by ECU 47. It is clear that in this instance the amount of spark advance is instantaneously increased at the beginning of the transition period and then gradually ramps up to a constant value by the end of the transition period. This maintains the smooth operation of the engine 12 and avoids the underspeed condition which would have occurred had the ECU 47 not changed the spark timing.

The control routines thus far described have, for the most part, assumed a constant or only slightly varying load on the engine 12, particularly at idle. This situation does not always prevail. Thus another feature provides for changing the number of active cylinders when load conditions may be different. For example outboard motors may be operated for long periods at idle. In neutral the engine will run at its normal idle speed. When trolling, on the other hand, the speed will fall well below idle speed. To prevent engine stalling there is provided a transmission condition sensor that indicates if the transmission is in neutral or drive (either forward or reverse). The ECU 47 automatically enables more cylinders when in drive than in neutral. Thus the ECU 47 will automatically increase the number of operating cylinders when shifting from neutral. In a like manner when shifting from drive to neutral, the number of operating cylinders will be automatically reduced.

Figure 4:
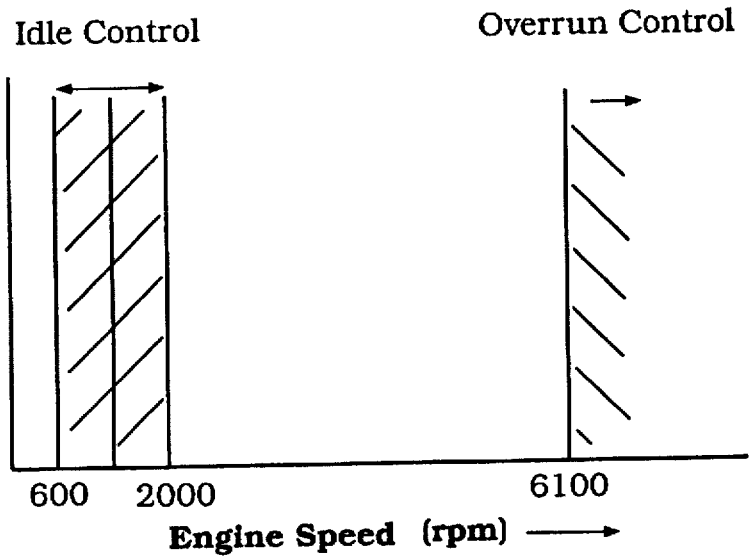
FIG. 4 is a graphical view showing the engine speed ranges and with the areas wherein engine control in accordance with the invention is accomplished being shown by the shaded areas.

In addition to controlling engine speed at idle and off idle when the position of the throttle valve 23 is held in its substantial partially opened condition, the misfiring principles disclosed may be utilized to limit or control maximum engine speed to a desired value regardless of load. These two control ranges are shown by the shaded areas in FIG. 4.

When reducing speed at wide open throttle it is best to discontinue cylinder operation by a manner other than by cutting off fuel supply. The reason for this is that the fuel vaporization in the engine serves to cool the engine. If the fuel supply is cut off, overheating may result. Thus when cylinders are disabled to limit maximum engine speed, the firing of the spark plugs 38 is disabled while the supply of fuel is not. The amount of fuel supplied may, however be reduced gradually but never completely.

Also the control may be utilized to reduce the likelihood of backfiring under deceleration. The engine 12 tends to backfire when its rotational speed lies between during periods of extreme deceleration. The crank angle sensor 56 outputs the engine rotational speed to the ECU 47. If the change in rotational speed lies within the backfire range while the engine 12 is decelerating the ECU 47 adjusts the ignition timing such that the ignition is retarded more slowly than would otherwise be the case, which effectively prevents a backfiring condition. The ECU 47 may also increase the amount of fuel supplied to the engine 12 per engine cycle, which will enrich the air/fuel mixture and thus prevent backfiring.

It should be understood that the described embodiments of the invention well serve the purposes set out therefor. Of course, it should be readily apparent that the foregoing description is of preferred embodiments of the invention, but that various changes and modifications may be made without departing from the spirit and scope of the invention, as defined by the appended claims.

What is claimed is:

1. An internal combustion engine having a plurality of combustion chambers, an induction system for supplying an air charge to said combustion chambers, a charge forming system for supplying fuel to said combustion chambers for combustion therein, an ignition system for igniting the charge in said combustion chambers for effecting combustion therein, and means for controlling the speed of said engine at at least one running condition by controlling the system associated with at least some of said combustion chambers for precluding combustion therein while maintaining substantially even firing intervals between the combustion chambers and varying the specific combustion chambers which are disabled with time while maintaining the same number of running combustion chambers and maintaining substantially equal firing intervals between those running combustion chambers.

2. An internal combustion engine as set forth in claim 1, wherein the longest interval between firing of adjacently firing combustion chambers under all running conditions does not exceed twice the shortest interval between the firing of adjacent combustion chambers.

3. An internal combustion engine as set forth in claim 1, wherein the preclusion of combustion in the combustion chambers is obtained by controlling the fuel supply.

4. An internal combustion engine as set forth in claim 3, wherein the fuel supply to the combustion chambers where combustion is precluded is substantially eliminated while the ignition system therein is maintained in an operative condition.

5. An internal combustion engine as set forth in claim 4, wherein the ignition system fires at least one spark plug in each combustion chamber.

6. An internal combustion engine as set forth in claim 1, wherein the engine is a reciprocating engine and the combustion chambers are formed by pistons, cylinder bores, and at least one cylinder head.

7. An internal combustion engine as set forth in claim 6, wherein the longest interval between firing of adjacently firing combustion chambers under all running conditions does not exceed twice the shortest interval between the firing of adjacent combustion chambers.

8. An internal combustion engine as set forth in claim 7, wherein the engine operates on a two-cycle crankcase compression principle.

9. An internal combustion engine as set forth in claim 8, wherein the charge-forming system supplies fuel to the engine upstream of the combustion chambers.

10. An internal combustion engine as set forth in claim 9, wherein the charge-forming system supplies fuel to the engine upstream of the crankcase chamber.

11. An internal combustion engine as set forth in claim 10, wherein the charge-forming system supplies fuel to the engine at a point upstream of a reed type check valve that controls the flow to the crankcase chamber through the upstream portion of the induction system.

12. An internal combustion engine as set forth in claim 11, further including a flow-controlling throttle valve in the induction system and the charge-forming system supplies fuel to the induction system between the throttle valve and the reed type check valve.

13. An internal combustion engine as set forth in claim 12, wherein the preclusion of combustion in the combustion chambers is obtained by controlling the fuel supply.

14. An internal combustion engine having a plurality of combustion chambers, an induction system for supplying an air charge to said combustion chambers including a throttle valve for controlling the flow through said induction system, a charge forming system for supplying fuel to said combustion chambers for combustion therein, an ignition system for igniting the charge in said combustion chambers for effecting combustion therein, means for controlling the position of said throttle valve under at least one running condition for permitting a greater air flow through said induction system than required to operate said engine at the desired speed for said running condition, and means for controlling the speed of said engine at said one running condition by controlling at least one of the systems associated with at least some of said combustion chambers for precluding combustion therein while maintaining substantially equal firing intervals between said combustion chambers.

15. An internal combustion engine as set forth in claim 14, further including an accelerator control operatively connected to the throttle valve for positioning the throttle valve.

16. An internal combustion engine as set forth in claim 15, wherein the operative connection between the accelerator and the throttle valve provides lost motion for movement of the accelerator from an idle position to an off-idle condition before the throttle valve moves from its one running condition to a fully opened condition.

17. An internal combustion engine as set forth in claim 16, wherein the means for controlling the speed of the engine at the one running condition controls the speed during the range of lost motion between the accelerator and the throttle valve.

18. An internal combustion engine as set forth in claim 17, wherein the means for controlling the speed of the engine also controls the speed of the engine when the throttle valve is in its fully opened position.

19. An internal combustion engine as set forth in claim 14, wherein the longest interval between firing of adjacently firing combustion chambers under all running conditions does not exceed twice the shortest interval between the firing of adjacent combustion chambers.

20. An internal combustion engine as set forth in claim 14, wherein the preclusion of combustion in the combustion chambers is obtained by controlling the fuel supply.

21. An internal combustion engine as set forth in claim 20, wherein the fuel supply to the combustion chambers where combustion is precluded is substantially eliminated while the ignition system therein is maintained in an operative condition.

22. An internal combustion engine as set forth in claim 21, wherein the ignition system fires at least one spark plug in each combustion chamber.

23. An internal combustion engine as set forth in claim 14, wherein the engine is a reciprocating engine and the combustion chambers are formed by pistons, cylinder bores, and at least one cylinder head.

24. An internal combustion engine as set forth in claim 23, wherein the longest interval between firing of adjacently firing combustion chambers under all running conditions does not exceed twice the shortest interval between the firing of adjacent combustion chambers.

25. An internal combustion engine as set forth in claim 24, wherein the engine operates on a two-cycle crankcase compression principle.

26. An internal combustion engine as set forth in claim 25, wherein the charge-forming system supplies fuel to the engine upstream of the combustion chambers.

27. An internal combustion engine as set forth in claim 26, wherein the charge-forming system supplies fuel to the engine upstream of the crankcase chamber.

28. An internal combustion engine as set forth in claim 27, wherein the charge-forming system supplies fuel to the engine at a point upstream of a reed type check valve that controls the flow to the crankcase chamber through the remainder of the induction system.

29. An internal combustion engine as set forth in claim 28, wherein the charge-forming system supplies fuel to the induction system between the throttle valve and the reed type check valve.

30. An internal combustion engine as set forth in claim 29, wherein the preclusion of combustion in the combustion chambers is obtained by controlling the fuel supply.

31. A method of operating an internal combustion engine having a plurality of combustion chambers, an induction system for supplying an air charge to said combustion chambers, a charge forming system for supplying fuel to said combustion chambers for combustion therein, an ignition system for igniting the charge in said combustion chambers for effecting combustion therein, said method comprising the steps of controlling the speed of said engine at at least one running condition by controlling the system associated with at least some of said combustion chambers for precluding combustion therein while maintaining substantially even firing intervals between the combustion chambers and varying the specific combustion chambers which are disabled with time while maintaining the same number of running combustion chambers and maintaining substantially equal firing intervals between those running combustion chambers.

32. A method of operating an internal combustion engine as set forth in claim 31, wherein the longest interval between firing of adjacently firing combustion chambers under all running conditions does not exceed twice the shortest interval between the firing of adjacent combustion chambers.

33. A method of operating an internal combustion engine as set forth in claim 31, wherein the preclusion of combustion in the combustion chambers is obtained by controlling the fuel supply.

34. A method of operating an internal combustion engine as set forth in claim 33, wherein the fuel supply to the combustion chambers where combustion is precluded is substantially eliminated while the ignition system therein is maintained in an operative condition.

35. A method of operating an internal combustion engine as set forth in claim 34, wherein the ignition system fires at least one spark plug in each combustion chamber.

36. A method of operating an internal combustion engine as set forth in claim 31, wherein the engine is a reciprocating engine and the combustion chambers are formed by pistons, cylinder bores, and at least one cylinder head.

37. A method of operating an internal combustion engine as set forth in claim 36, wherein the longest interval between firing of adjacently firing combustion chambers under all running conditions does not exceed two times the shortest interval between the firing of adjacent combustion chambers.

38. A method of operating an internal combustion engine as set forth in claim 37, wherein the engine operates on a two-cycle crankcase compression principle.

39. A method of operating an internal combustion engine as set forth in claim 38, wherein the charge-forming system supplies fuel to the engine upstream of the combustion chambers.

40. A method of operating an internal combustion engine as set forth in claim 39, wherein the charge-forming system supplies fuel to the engine upstream of the crankcase chamber.

41. A method of operating an internal combustion engine as set forth in claim 40, wherein the charge-forming system supplies fuel to the engine at a point upstream of a reed type check valve that controls the flow to the crankcase chamber through the upstream portion of the induction system.

42. A method of operating an internal combustion engine as set forth in claim 41, wherein said engine includes a throttle valve for controlling the flow through said induction system and wherein the charge-forming system supplies fuel to the induction system between the throttle valve and the reed type check valve.

43. A method of operating an internal combustion engine as set forth in claim 42, wherein the preclusion of combustion in the combustion chambers is obtained by controlling the fuel supply.

44. A method of operating an internal combustion as set forth in claim 31, said engine further including a throttle valve for controlling the flow through said induction system, and an accelerator control operatively connected to the throttle valve for positioning the throttle valve.

45. A method for operating an internal combustion engine as set forth in claim 44, wherein the operative connection between the accelerator and the throttle valve provides lost motion for movement of the accelerator from an idle position to an off-idle condition before the throttle valve moves from its one running condition to a fully opened condition.

46. A method for operating an internal combustion engine as set forth in claim 45, wherein the means for controlling the speed of the engine at the one running condition controls the speed during the time of lost motion between the accelerator and the throttle valve.

47. A method for operating an internal combustion engine as set forth in claim 46, wherein the means for controlling the speed of the engine also controls the speed of the engine when the throttle valve is in its fully opened position.

48. A method for operating an internal combustion engine as set forth in claim 45, wherein the longest interval between firing of adjacently firing combustion chambers under all running conditions does not exceed twice the shortest interval between the firing of adjacent combustion chambers.

49. A method for operating an internal combustion engine as set forth in claim 46, wherein the preclusion of combustion in the combustion chambers is obtained by controlling the fuel supply.

50. A method for operating an internal combustion engine as set forth in claim 49, wherein the fuel supply to the combustion chambers where combustion is precluded is substantially eliminated while the ignition system therein is maintained in an operative condition.

51. A method for operating an internal combustion engine as set forth in claim 50, wherein the ignition system fires at least one spark plug in each combustion chamber.

52. An internal combustion engine having a plurality of combustion chambers, an induction system for supplying an air charge to said combustion chambers, a charge forming system for supplying fuel to said combustion chambers for combustion therein, an ignition system for igniting the charge in said combustion chambers for effecting combustion therein, and means for controlling the speed of said engine during at least one running condition by controlling the system associated with at least two of said combustion chambers for precluding combustion therein while maintaining substantially even firing intervals between the remaining combustion chambers and maintaining the same number of running combustion chambers per cycle of said engine.

53. An internal combustion engine in accordance with claim 52, wherein said engine includes a piston reciprocally mounted in each of said combustion chambers, said pistons connected to a crankshaft for rotation thereof, and wherein said cycle of said engine comprises a single rotation of said crankshaft.

54. An internal combustion engine in accordance with claim 52, wherein a longest interval between firing of adjacently firing combustion chambers under all running conditions does not exceed twice the shortest interval between the firing of adjacent combustion chambers.

* * * * *